US007214869B2

(12) United States Patent
Lee

(10) Patent No.: US 7,214,869 B2
(45) Date of Patent: May 8, 2007

(54) METHOD FOR GENERATING AND PLAYING A MUSICAL FILE AND A COMPUTER-READABLE MEDIA STORING THE MUSICAL FILE

(75) Inventor: Chung-Hsien Lee, Hsinchu (TW)

(73) Assignee: Sunplus Technology Co., Ltd. (TW)

( * ) Notice: Subject to any disclaimer, the term of this patent is extended or adjusted under 35 U.S.C. 154(b) by 349 days.

(21) Appl. No.: 10/730,129

(22) Filed: Dec. 9, 2003

(65) Prior Publication Data

US 2005/0120869 A1 Jun. 9, 2005

(30) Foreign Application Priority Data

Jun. 2, 2003 (TW) ..... 92114941 A

(51) Int. Cl.
*G10H 7/00* (2006.01)

(52) U.S. Cl. ..... 84/601; 84/609; 84/649

(58) Field of Classification Search ..... 84/601, 84/609–614, 649–652
See application file for complete search history.

(56) References Cited

U.S. PATENT DOCUMENTS

| | | | | |
|---|---|---|---|---|
| 6,949,705 | B2 * | 9/2005 | Furukawa | 84/610 |
| 2003/0101862 | A1 * | 6/2003 | Furukawa | 84/610 |
| 2005/0066796 | A1 * | 3/2005 | Hikawa et al. | 84/603 |

* cited by examiner

*Primary Examiner*—Lincoln Donovan
*Assistant Examiner*—David S. Warren

(74) *Attorney, Agent, or Firm*—Bacon & Thomas PLLC

(57) ABSTRACT

A method for generating and playing a musical file and a computer-readable record medium with the musical file. The method records events performed at the same time respectively by an event field, and also the event fields correspond to a time field, such that a musical file can have less file length. When reading a musical file on a computer-readable record medium, both a time field with respect to the musical file and corresponding event field or fields are read.

10 Claims, 4 Drawing Sheets

METHOD FOR GENERATING AND PLAYING A MUSICAL FILE AND A COMPUTER-READABLE MEDIA STORING THE MUSICAL FILE

BACKGROUND OF THE INVENTION

1. Field of the Invention

The present invention relates to a method for generating a musical file and, more particularly, to a method for generating time field and event field of a musical file, in the form of the formats of time field and event field of MIDI (Music Instrument Digital Interface), and playing the musical file, and a computer-readable media storing the musical file.

2. Description of Related Art

Among digital music playback techniques, MIDI file format is a very popular standard. MIDI file format can be divided into SMF (standard MIDI format) and SMAF (synthetic music mobile application format). As shown in FIG. 1, SMF includes a time field 11, a status field 12 and a data field 13. The time field 11 is provided to record relative time. The status field 12 is provided to record status of musical parts. The data field 13 is provided to record musical data. A musical record includes a time field, a status field and a data field. An SMF file includes at least two musical records.

SMAF is standardized for portable electronics by YAMAHA cooperation; for example, a cell phone provides 20 chords in SMAF. As shown in FIG. 2, SMAF can be divided into a time field 21 and an event field 22. The time field 21 is provided to record relative time. The event field 22 is provided to record music playback events. The event field 22 can be regarded as a combined and simplified content of the status field 12 and data field 13. Thus, a musical record includes a time field 21 and an event field 22. An SMAF file includes at least two musical records. By comparison, it is obvious that using SMAF format can possess a file length less than using SMF format.

Also, from the afirementioned SMF and SMAF files respectively shown in FIGS. 1 and 2, it is known that, if more musical parts are played at a same time, more time fields are contained at the same time, thus wasting more memory space for such a file. Accordingly, the use of portable electronics that only have limited memory is not satisfactory. Therefore, it is desirable to provide an improved method to mitigate and/or obviate the aforementioned problems.

SUMMARY OF THE INVENTION

An object of the present invention is to provide a method for generating a musical file having less file length.

Another object of the present invention is to provide a method for playing a musical file, which can accurately play the musical file.

A further object of the present invention is to provide a computer-readable medium having a musical file with less file length.

According to a feature of the present invention, a method for generating a musical file is provided, wherein the musical file offers a plurality of events to play. The method includes the following steps: (A) recording a relative time to a time field; (B) recording an event corresponding to the relative time to an event field; (C) determining if events corresponding to the relative time are recorded complete, if not, performing step (B); (D) determining if all events are recorded complete, if not, performing step (A); and (E) outputting the musical file.

According to another feature of the present invention, a method for playing the musical file is provided, wherein the musical file includes time fields and event fields and each time field corresponds to at least one event field. The method includes the following steps: (A) reading the musical file; (B) determining a time field's length of the musical file; (C) decoding the time field based on the time field's length, to thus obtain a relative time's length represented by the time field; (D) decoding an event field corresponding to the time field, to thus obtain corresponding music playback event; (E) determining if events corresponding to the time field are decoded complete, if not, performing step (D); and (F) playing music based on the relative time's length and the music playback event corresponding to one or more event fields, and subsequently repeating step (B) until the musical file ends.

According to a further feature of the present invention, a computer-readable record media is provided, which stores a musical file for use in an information device. The musical file comprises a plurality of time fields and event fields arranged in a series, wherein a time field is followed by one or a plurality of event fields corresponding to the time field, and the plurality of event fields represent a plurality of music playback events occurred in the same time.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
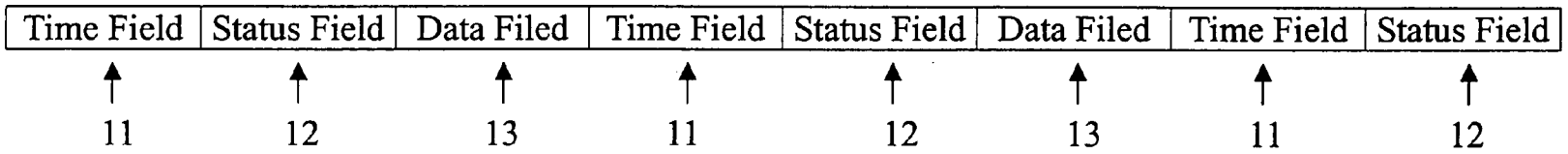
FIG.1(PRIOR ART)
FIG. 1 is a schematic view of a typical SMF file.
Figure 2:
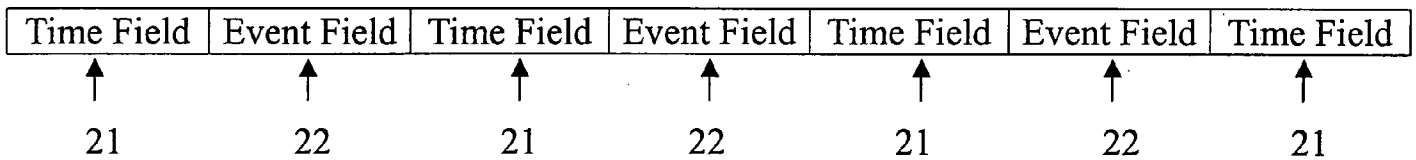
FIG.2(PRIOR ART)
FIG. 2 is a schematic view of a typical SMAF file.
Figure 3:
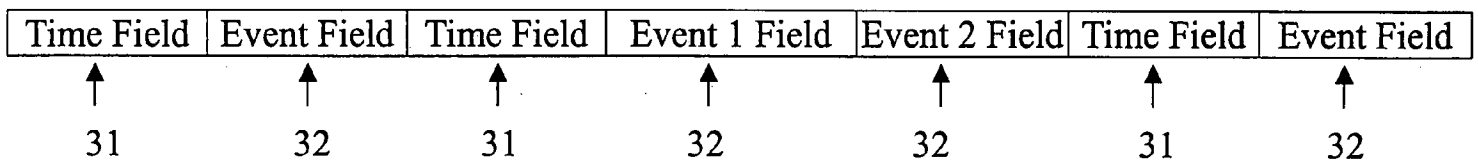
FIG. 3 is a schematic view of a musical file format in accordance with the invention.

With reference to FIG. 3, there is shown the format of a musical file generated by the inventive method. As shown, one or more events occurred in the same time (recorded in event field 32) are corresponding to a single time field 31; i.e., the musical file is formed by a plurality of time fields 31 and event fields 32 arranged in a series, where a time field 31 is followed by one or a plurality of event fields 32 corresponding to the time field 31, thus saving the musical file's length.

Figure 4:
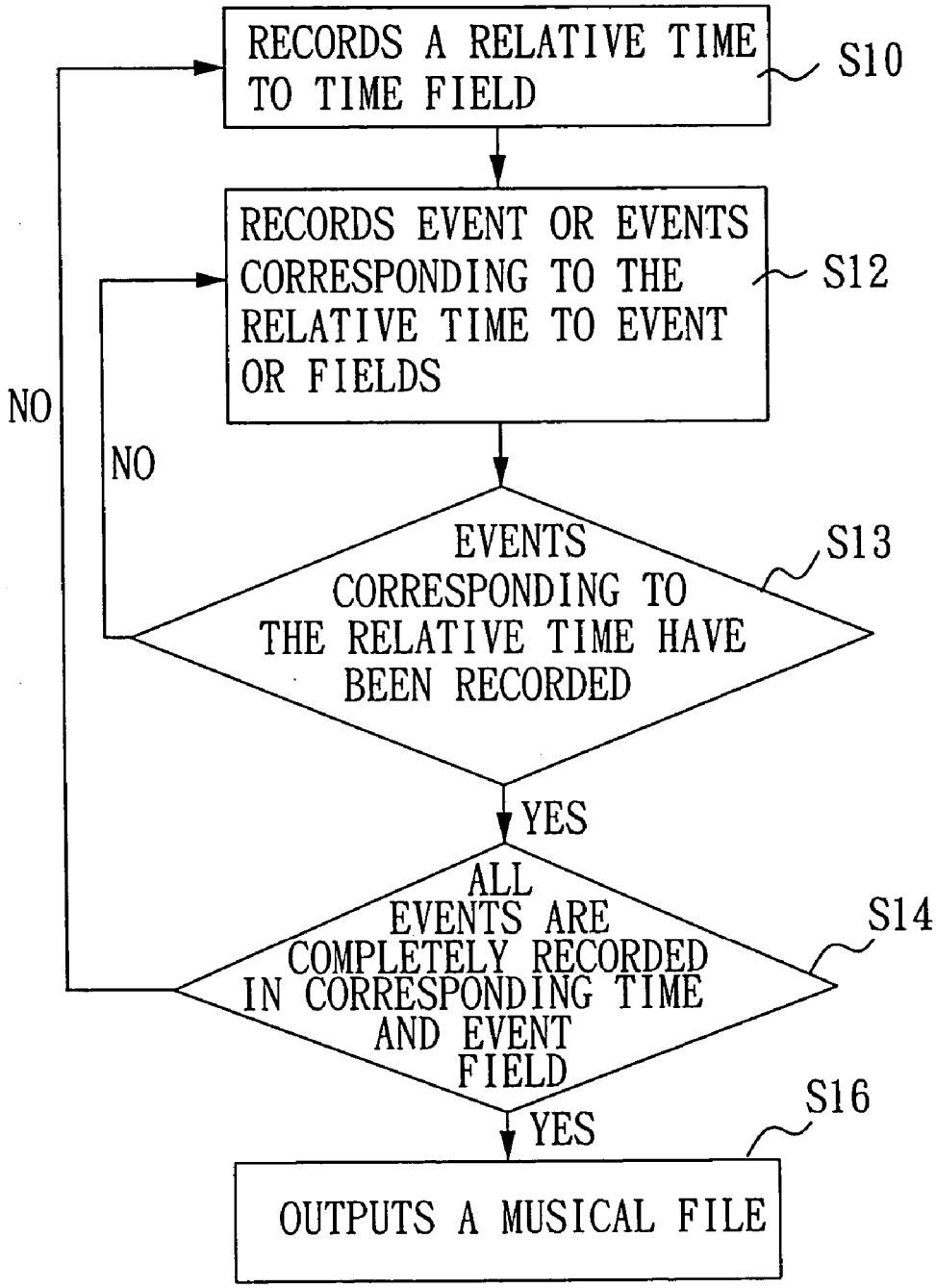
FIG. 4 is a flowchart of a method for generating a musical file in accordance with the invention.

FIG. 4 is a flowchart of a method for generating the musical file of FIG. 3. As shown, the method includes the following steps.

Figure 6:
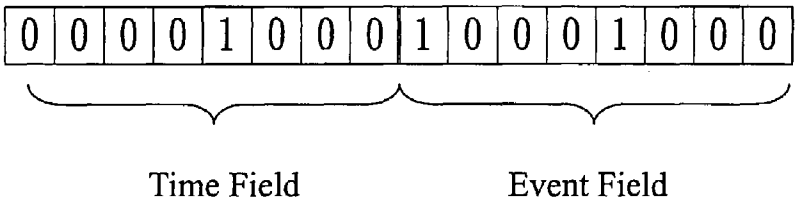
FIG. 6 is a schematic view of an example of time and event fields in accordance with the invention.
Figure 7:
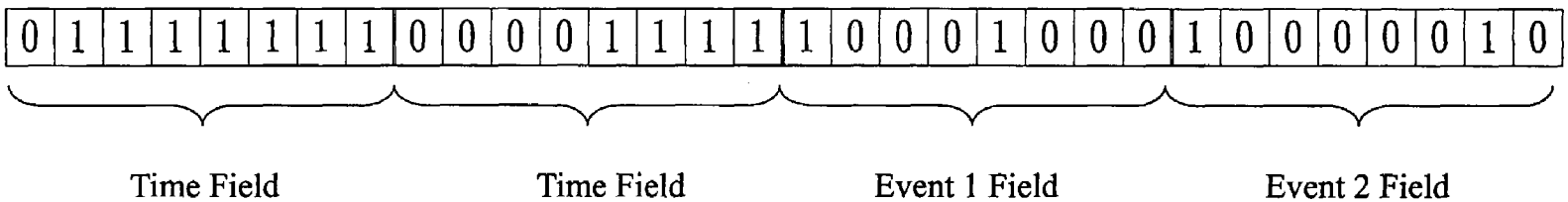
FIG. 7 is a schematic view of another example of time and event fields in accordance with the invention.

Step S10 records a relative time to a time field. The record format of the time field is met with required format of SMF or SMAF time field. The content of time field is a relative time shown in FIG. 6. As shown in FIG. 6, the time field and the event field are represented by an 8-bit length respectively. Furthermore, the first bit, in case of 0, represents that current field is a time field. The second bit represents the length of the time field. The following 6 bits indicate the relative time represented by the time field. For example, the former 2 bits of the 6 bits, in case of 00, it indicates that to represent the length of the time field needs only one time field's length; in case of 01, it indicates that to represent the length of the time field needs to add a next time field more, so that a real relative time can be found. Accordingly, FIG. 6 shows that a relative time represented by the time field is 4 seconds, i.e., corresponding event is enabled after 4 seconds. However, when a relative time is over 63 seconds, the 6 bits are not enough to represent the relative time, and thus more than one time fields for recording a time length are needed. As shown in FIG. 7, the first time field represents a 63-second time length and the second time field represents a 31-second time length, and thus, the total length of relative time is 94 seconds.

Step S12 records event or events corresponding to the relative time to event field or fields. When the first bit of the event field is 1, it indicates that the current field is an event field. In this case, the following seven bits are recorded with event codes representing events to be performed. For example, assumed that a timbre of violin is to be enabled after 4 seconds, an event code 8 for the timbre of violin is recorded as shown in FIG. 6. In addition, as shown in FIG. 7, because more than one events can be corresponding to a same relative time, besides the timbre of violin (with the event code 8), a timbre of piano (with a supposed event code 2) is also performed after 94 seconds. Therefore, step S13 determines whether events corresponding to the relative time have been recorded; if not, step S12 is repeated to continuously record the remaining events.

Step S14 determines whether all events are completely recorded in corresponding time and event fields; if not, step S10 is repeated, otherwise, step S16 is executed.

Step S16 outputs a musical file. In an inventive musical file, the time field and the event field have the same record format as that in the prior art, but the inventive time field can correspond to more than one event fields, which is different from that in the prior art. Therefore, the inventive musical file can be recorded by a file length less than the prior art.

Figure 5:
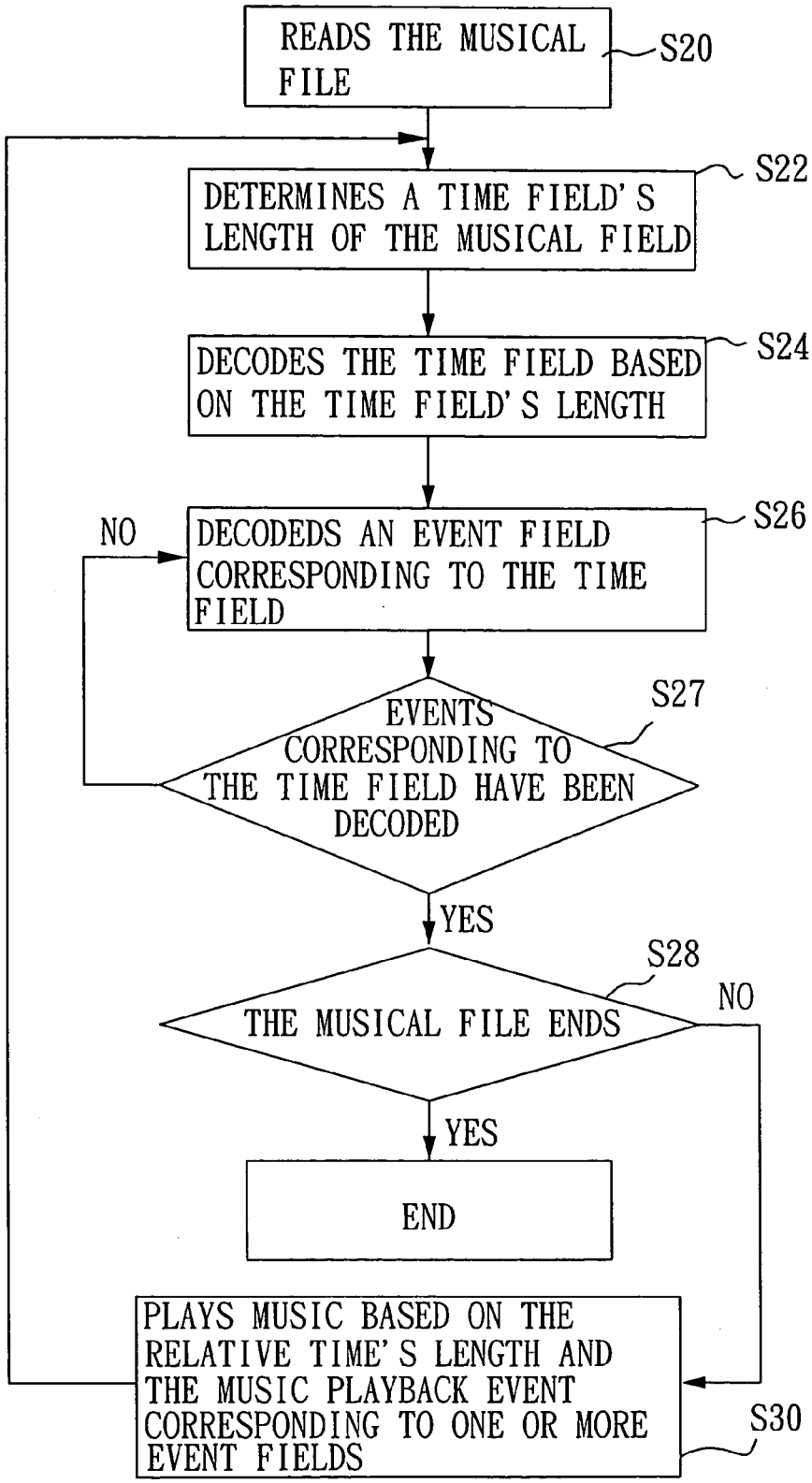
FIG. 5 is a flowchart of the method for playing a musical file in accordance with the invention.

Furthermore, the musical file generated by FIG. 4 is read and played by the method of FIG. 5. As shown in FIG. 5, the method includes the following steps.

Step S20 reads the musical file.

Step S22 determines a time field's length of the musical file.

Step S24 decodes the time field based on the time field's length to thus obtain a relative time's length represented by the time field, for example, the 4-second time length in FIG. 6 and the 94-second time length in FIG. 7.

Step S26 decodes an event field corresponding to the time field to thus obtain corresponding music playback event. As known, a same time field may correspond to more than one event fields; for example, in FIG. 7, the timbres of violin and piano are performed at the same time. Step S27 further determines whether events corresponding to the time field have been decoded; if not, step S26 is repeated to continuously decode the remaining event fields.

Step S28 determines whether the musical file ends; if not, step S30 is executed to play music based on the relative time's length and the music playback event corresponding to at least one event field. On the other hand, music playing is stopped when the musical file ends with a meaningless or special (such as 1111111) content for the event field. In addition, the musical file ends when a time field is decoded and a relative time represented by the time field is obtained as zero, and it is determined that all events of the musical file are performed completely.

The inventive method produces a musical file met with the formats of time field and event field of MIDI, wherein one time field can correspond to more than one event fields. Thus, the musical file has a file length less than a prior MIDI file and the inventive purpose is achieved.

The aforementioned musical file can be stored on any recording media that can be recognized and decoded by a processing unit, or any product comprising such a recording media. The recording media can be a hard disk, a floppy disk, an optical disk, a ZIP disk, an MO, an IC chip, RAM, or any other known product.

Although the present invention has been explained in relation to its preferred embodiment, it is to be understood that many other possible modifications and variations can be made without departing from the spirit and scope of the invention as hereinafter claimed.

What is claimed is:

1. A method for generating a musical file which provides a plurality of events to be played, comprising the steps of:

(A) recording a relative time to a time field;

(B) recording one of a group of events corresponding to the relative time to an event field, wherein the group may include any number of events corresponding to the relative time;

(C) determining whether all of the events of said group of events corresponding to the relative time are recorded completely, and if not, repeating step (B) such that any number of events corresponding to the relative time may be recorded to the event field;

(D) determining whether all the plurality of events are recorded completely, and if not, executing step (A); and (E) outputting the musical file.

2. The method as claimed in claim 1, wherein the time field has a record format met with a standard MIDI format (SMF).

3. The method as claimed in claim 1, wherein the event field has a record format met with a standard MIDI format (SMF).

4. The method as claimed in claim 1, wherein the time field has a record format met with a synthetic music mobile application format-(SMAF).

5. The method as claimed in claim 1, wherein the event field has a record format met with a synthetic music mobile application format (SMAF).

6. A method for playing a musical file which includes time fields and event fields, wherein each field corresponds to at least one event field, the method comprising the steps of:

(A) reading the musical file;

(B) determining a time field's length of the musical file;

(C) decoding the time field based on the time field's length, thus obtaining a relative time's length recorded in the time field based on the time field's length;

(D) decoding an event field corresponding to the time field, to obtain one of a group of events recorded in an event field corresponding to the time field, wherein the group may include any number of events corresponding to the relative time;

(E) determining whether all of the events of said group of events corresponding to the time field are decoded completely, if not, repeating step (D) such that any number of events corresponding to the relative time may be recorded to the event field; and (F) playing music according to the relative time's length and the music playback event corresponding to one or more event fields, and subsequently executing step (B) until the musical file ends.

7. The method as claimed in claim 6, wherein the time field has a record format met with an SMF.

8. The method as claimed in claim 6, wherein the event field has a record format met with an SMF.

9. The method as claimed in claim 6, wherein the time field has a record format met with an SMAF.

10. The method as claimed in claim 6, wherein the event field has a record format met with an SMAF.

* * * * *